US005368124A

United States Patent [19]

Fukutomi

[11] Patent Number: 5,368,124

[45] Date of Patent: Nov. 29, 1994

[54] DEVICE SUSPENDING A WORKING CAGE

[75] Inventor: Osamu Fukutomi, Tokyo, Japan

[73] Assignee: Nihon Biso Co., Ltd., Tokyo, Japan

[21] Appl. No.: 72,768

[22] Filed: Jun. 7, 1993

[30] Foreign Application Priority Data

Jun. 16, 1992 [JP] Japan ..... 4-181734

[51] Int. Cl.[5] ..... E04G 3/10

[52] U.S. Cl. ..... 182/142; 182/37; 212/148

[58] Field of Search ..... 182/142, 150, 36, 37; 212/147, 148, 252, 223; 187/6

[56] References Cited

U.S. PATENT DOCUMENTS 4,270,628 6/1981 Anderson ..... 182/37 X
4,386,680 6/1983 Reed ..... 182/142 X

*Primary Examiner*—Alvin C. Chin-Shue
*Attorney, Agent, or Firm*—Hedman, Gibson & Costigan

[57] ABSTRACT

A device for suspending a working cage includes an arm, a swivel arm mounted rotatably horizontally to the end portion of the arm, a first sheave mounted rotatably horizontally to the arm at a location behind the end portion to which the swivel arm is mounted, and a second sheave mounted rotatably horizontally to the swivel arm in front of the center of rotation of the swivel arm. The first and second sheaves have the same diameter and are formed with at least two vertically arranged wire rope engaging grooves. At least two wire ropes fed from a winding device and attached to a working cage through these sheaves cross each other between the first sheave and the second sheave. The distance between the center of rotation of the swivel arm and the center of rotation of the first sheave is determined to be equal to the distance between the center of rotation of the swivel arm and the center of rotation of the second sheave. By this arrangement, entwining of wire ropes and inclination of the working cage due to imbalance in length of respective wire ropes can be prevented.

3 Claims, 7 Drawing Sheets

DEVICE SUSPENDING A WORKING CAGE

BACKGROUND OF THE INVENTION

This invention relates to a device for movably suspending a working cage in which a workman can work on an outer wall surface of a building and, more particularly, to a device which is particularly suitable for suspending a working cage which is suspended from a roof car which runs along rails aid along the periphery of a roof of a building.

Known in the art is a device for suspending a working cage for performing work on an outer wall surface of a building which, as shown in FIG. 7, includes an arm c secured to a roof car b which can run along rails a laid along the periphery of a roof of a building and one or two swivel arms d which are mounted rotatably horizontally to the under surface of the forward end portion of the arm c. In this prior art device, wire ropes f for suspending a working cage e are secured at one end thereof to a winding device g disposed in the roof car b and, at the other end thereof, to the working cage e. For example, as shown in FIG. 8, wire ropes f consisting typically of two wire ropes f1 and f2 which extend horizontally through the inside space of the arm c are tuned in the vertical direction by a sheave h mounted to the forward end portion of the arm c in such a manner that the sheave h can rotate in a vertical place and extend vertically through a swivel mechanism I for rotating the swivel arm d horizontally. The wire ropes f are then turned in the horizontal direction by sheaves j and k mounted to the swivel arm d at locations below the sheave h in such a manner that they can rotate in a vertical plane. The wire ropes f extend horizontally through a space inside the swivel arm d, are turned again in the vertical direction by sheaves l and m mounted to the ends of the swivel arm d and extend to the working cage e.

In the prior art device shown in FIGS. 7 and 8, the swivel arm d is disposed below the arm c but there is also a prior art device in which the swivel arm d is disposed above the arm c.

When work is performed on the wall surface by the working cage e of the prior art device shown in FIGS. 7 and 8, the winding device g is operated to unwind the wire ropes f from the winding device g or wind them into the winding device g and thereby lower or lift the working cage e.

The prior art device has the advantage that work is facilitated by rotating the swivel arm d when work is performed along a corner portion of a building.

The prior art device for suspending a working cage has however the disadvantage that, when the swivel arm d is rotated by a desired angle by driving the swivel mechanism i, the sections of the two wire ropes f1 and f2 extending in the vertical direction, i.e., the sections between the sheave h and the sheaves k, j, are twisted to twine about each other and, since the wire ropes f1 and f2 are wound or unwound by the winding device g in this entwined state, friction occurs between the wire ropes f1 and f2 with resulting wear and short life of the wire ropes f1 and f2. For this reason, wire ropes must be frequently replaced in this type of device which is disadvantageous both in working efficiency and maintenance and other costs.

Particularly, in a case where a working cage is suspended at four corners of its top surface by four wire ropes through a single arm, friction caused by entwining of four wire ropes in the vertical section is much stronger than in the case of using two wire ropes and, therefore, it has been considered almost impossible to realize suspension of a working cage by four wire ropes through a single arm and, in practice, suspension of a working cage by four wire ropes is effected by using a device having two arms, each arm dealing with two wire ropes. This device using two arms however requires a very complex construction and a troublesome operation because the two arms need to be actuated synchronously in operation.

It is, therefore, an object of the invention to provide a device for suspending a working cage capable of prolonging the life of wire ropes by preventing occurrence of friction caused by entwining of the wire ropes and thereby improving working efficiency and reducing costs.

SUMMARY OF THE INVENTION

For achieving the above described object of the invention, a device for suspending a working cage comprises an arm, a swivel arm mounted rotatably horizontally to the end portion of the arm, a first sheave mounted rotatably horizontally to said arm at a location behind the end portion to which said swivel arm is mounted, said first sheave being formed with at least two vertically arranged grooves in which wire ropes engage, a second sheave having a diameter equal to that of said first sheave and being mounted rotatably horizontally to said swivel arm at a location in front of the center of rotation of said swivel arm, said second sheave being formed with at least two vertically arranged grooves in which wire ropes engage, a wire rope winding device provided on the base side of said arm for winding and unwinding wire ropes, and at least two wire ropes for suspending the working cage, one end of the respective wire ropes being attached to said wire rope winding device and the other end of the respective wire ropes being attached to said working cage, and the respective wire ropes being wound and unwound through said first sheaves and said second sheaves, said wire ropes crossing each other in a space between said first sheave and said second sheaves and said swivel arm, said first sheave and said second sheave being positioned in such a manner that distance between the center of rotation of said swivel arm and the center of rotation of said first shears becomes substantially equal to distance between the center of rotation of said swivel arm and the center of rotation of said second sheaves.

According to the invention, by providing the first and second sheaves which are rotatable in a horizontal plane and are formed with at least two vertically arranged grooves in which wire ropes engage, one of the two wire ropes can engage in the upper groove and the other wire rope can engage in the lower groove and, accordingly, the wire ropes in the respective grooves are prevented from entwining when the swivel arm is rotated in one direction.

According to the invention, the first and second sheave have an equal diameter, the swivel arm, the first sheaves and the second sheaves are positioned in such a manner that distance between the center of rotation of the swivel arm and the center of rotation of the first sheave becomes substantially equal to distance between the center of rotation of the swivel arm and the center of rotation of the second sheave, and the wire ropes cross each other in a space between the first sheave and the second sheave. By this arrangement, when the swivel arm is rotated in one direction, the sum of angle of winding of each wire rope about the first sheave and angle of winding thereof about the second sheave becomes always constant and the length of a fed out or withdrawn portion of one wire rope becomes the same as the length of a fed out or withdrawn portion of the other wire rope. Accordingly, regardless of the rotated position of the swivel arm, the length of one wire rope suspending the working cage becomes the same as the length of the other wire rope whereby there is no likelihood that the working cage is inclined due to imbalance in the length of respective wire ropes.

According to the invention, a single arm will suffice for supplying four wire ropes even when a working cage is suspended by four wire ropes and, therefore, the device according to the invention is improved in working efficiency and costs can be reduced as compared to the prior art device.

A preferred embodiment of the invention will be described below with reference to the accompanying drawings.

BRIEF DESCRIPTION OF THE DRAWINGS

In the accompanying drawings.

DESCRIPTION OF A PREFERRED EMBODIMENT

Figure 1:
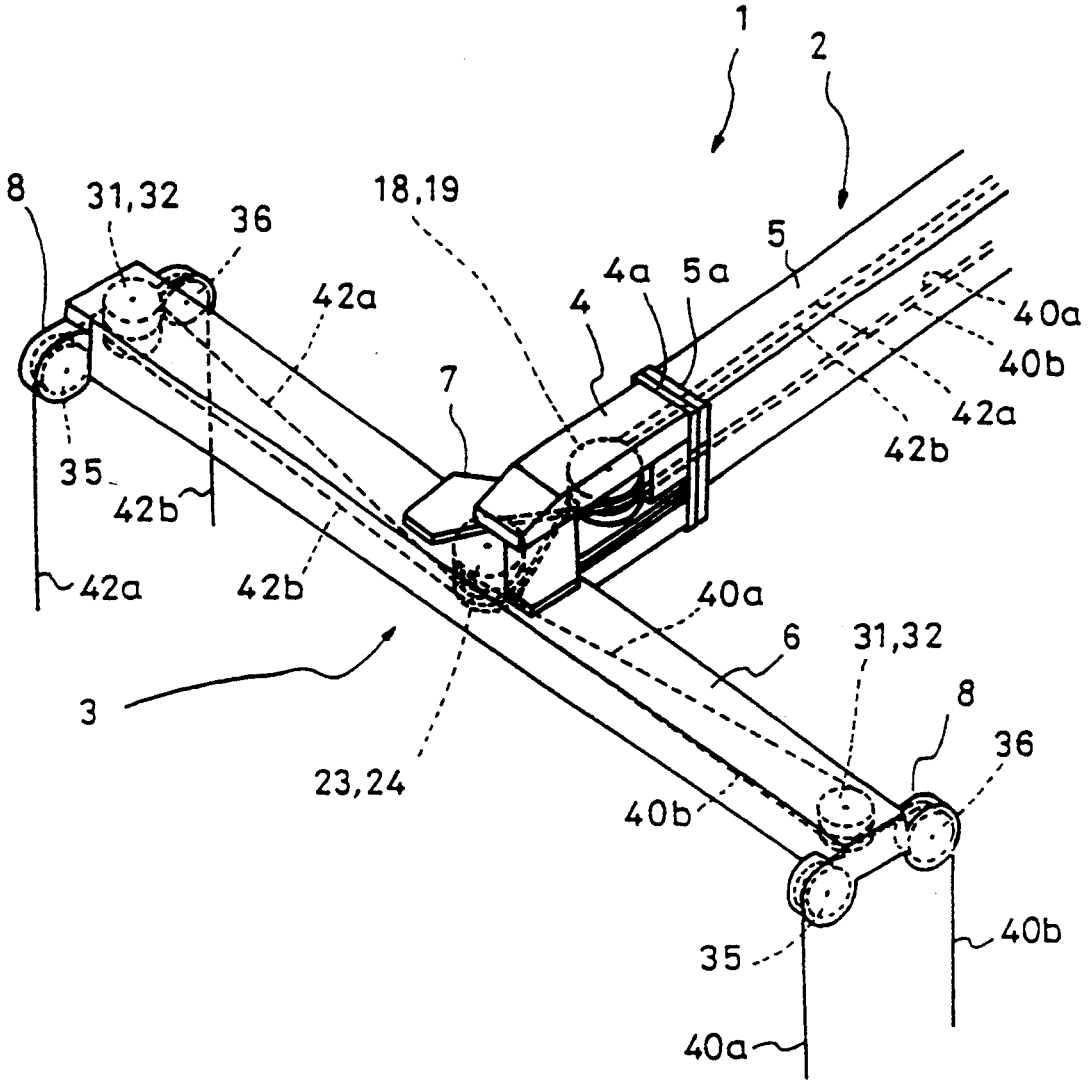
FIG. 1 is a perspective view showing schematically an embodiment of the device made according to the invention.
Figure 7:
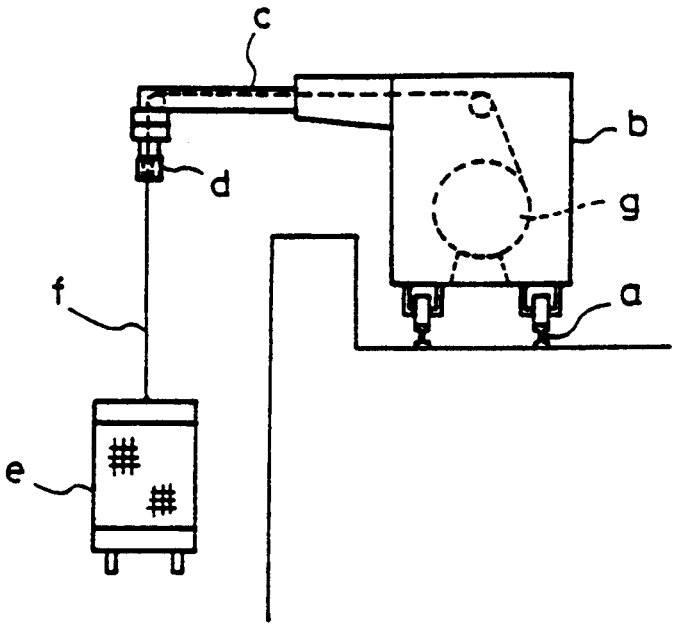
FIG. 7 PRIOR ART
FIG. 7 is a view showing an example of prior art suspending devices.
Figure 8:
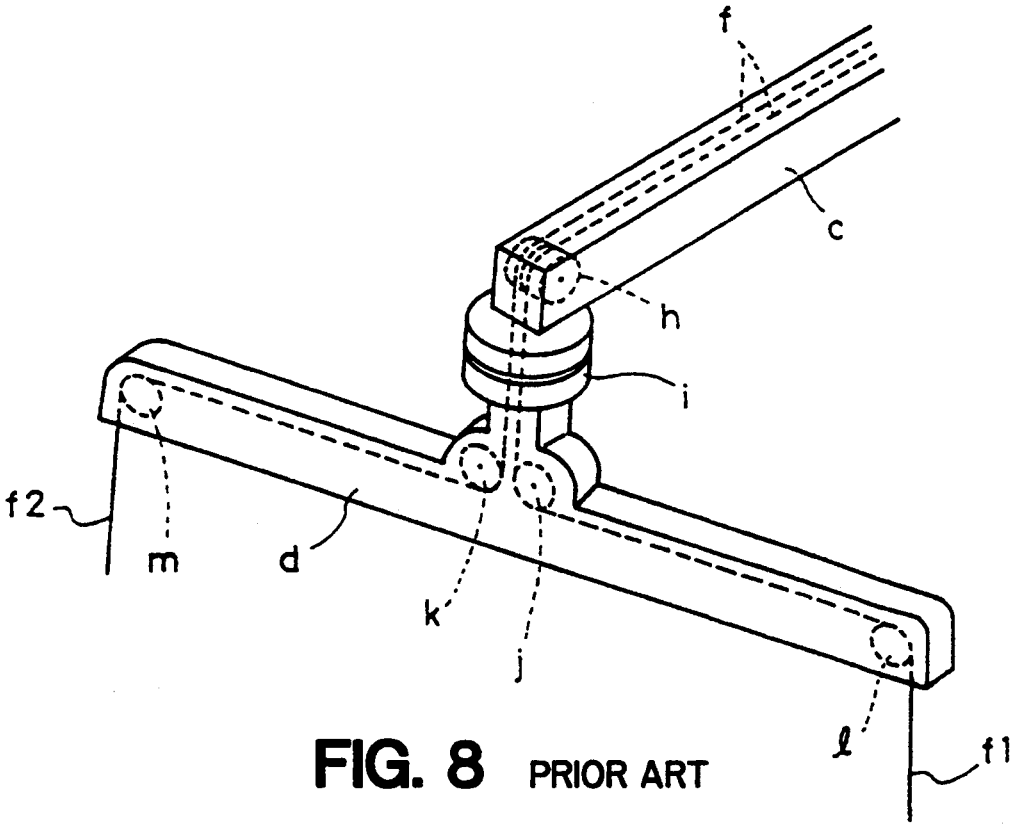
FIG. 8 PRIOR ART
FIG. 8 is a view showing the swivel arm in the prior art suspending device.

Referring first to FIG. 1, a device 1 for suspending a working cage includes an elongated arm 2 of a square hollow cross section. The arm 2 is mounted rotatably to a roof car (not shown) which runs along rails in the same manner as the prior art device shown in FIG. 7. The base portion of the arm 2 is telescopically constructed so that the arm 2 can be stretched and withdrawn. This design is the same as that of the prior art device so that illustrating and detailed description thereof will be omitted. The roof car may be one which moves along the periphery of the roof without rails or may be one which is stationary and rotatable.

In the illustrated embodiment, a forward end portion 4 of the arm 2 is produced separately from a main body 5 of the arm 2 and secured fixedly at a flange 4*a* to a flange 5*d* of the main body 5 by means of bolts or the like.

Figure 2:
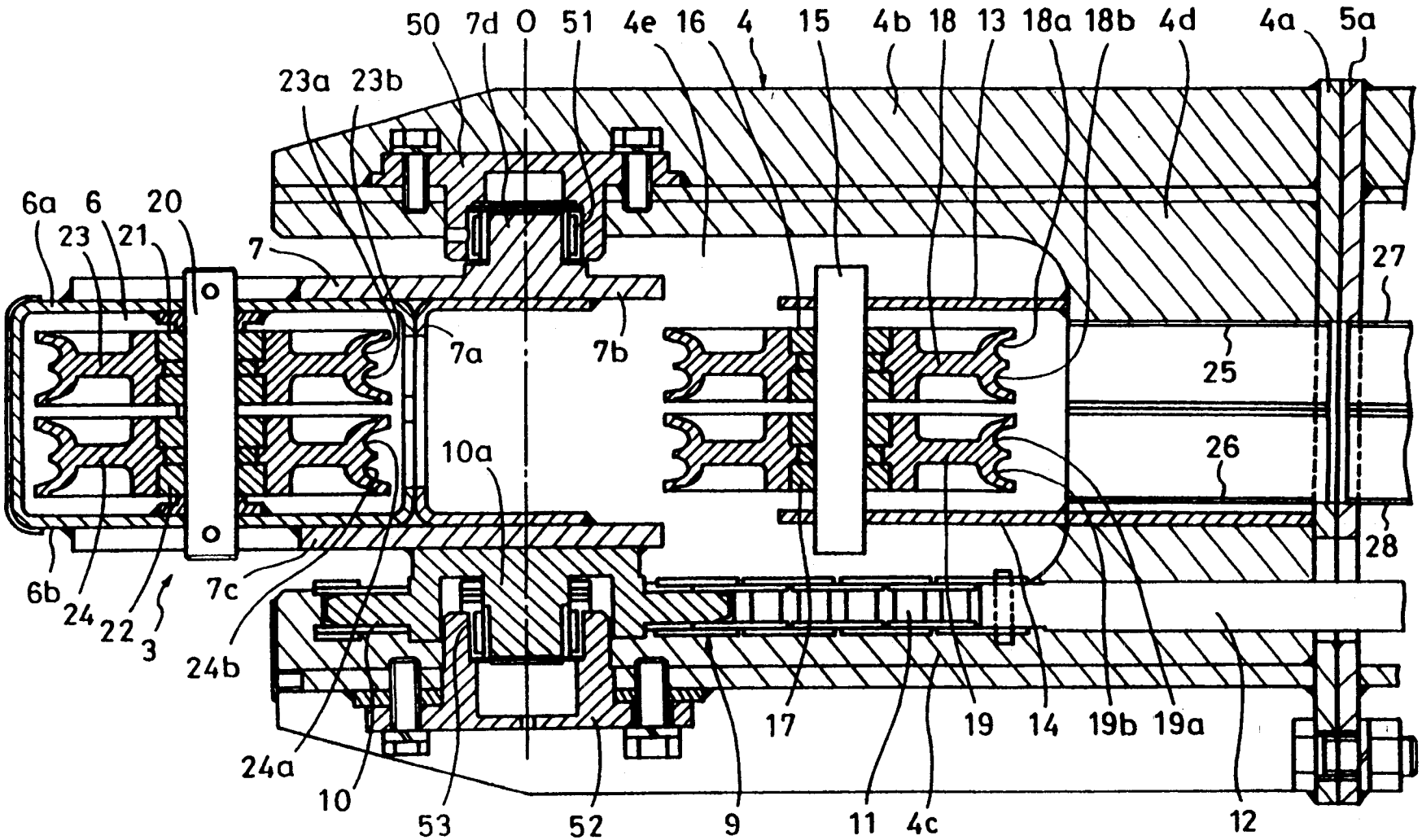
FIG. 2 is a vertical sectional view showing a part of a forward end portion of an arm and a part of a swivel arm.

The swivel arm 3 is mounted rotatably horizontally to the forward end portion 4 of the arm 2, As shown in FIG. 2, the forward end portion 4 of the arm 2 consists of an upper projecting portion 4*b*, a lower projecting portion 4*c* and a base portion 4*d* with an opening 4*e* being formed between the upper projecting portion 4*b* and the lower projecting portion 4*c*.

The swivel arm 3 comprises an elongated swivel arm main body 6 of a hollow rectangular cross section extending horizontally, a connecting portion 7 which connects the swivel arm main body 6 rotatably to the forward end portion 4 of the arm 2, and a pair of cage suspending portions 8 formed at the end portions of the swivel arm main body 6. The length of the swivel arm main body 6 is determined depending upon the length of a working cage suspended and the length of the cage suspending portions 8 is determined depending upon the lateral length of the working cage.

As shown In FIG. 2, the connecting portion 7 of the swivel arm 3 has an upper connecting plate 7*b* and a lower connecting plate 7*c* which are interconnected by a connecting member 7*a* of a generally C-shaped cross section, The upper connecting plate 7*b* has a columner central projection 7*d* which is rotatably supported by the forward end portion 4 of the arm 2 through a bearing 51 received in a bearing box 50 which is buried in the upper projecting portion 4*b* of the forward end portion 4.

The lower connecting plate 7*c* is secured rigidly to a boss 10*a* of a chain wheel 10 which constitutes a part of a swivel arm drive mechanism 9 to be described later. The boss 10*a* is rotatably supported by the lower projecting portion 4*c* of the forward end portion 4 of the arm 2 through a bearing 53 received in a bearing box 52.

The upper connecting plate 7*b* and the lower connecting plate 7*c* are secured rigidly to the swivel arm main body 6 such that the swivel arm main body 6 is held between these plates 7*b* and 7*c*.

The axis of the central projection 7*d* of the upper connecting plate 7*b* and the axis of the boss 10*a* of the chain wheel 10 constitute the center of rotation of the connecting portion 7, i.e., the center O of rotation of the swivel arm 3.

In the present embodiment, the drive mechanism 9 for rotating the swivel arm 3 includes the chain wheel 10, a chain 11 extending along both sides of the lower projecting portion 4*c* of the forward end portion 4 of the arm 2 in such a manner that the chain 11 will mesh with a half circumference of the chain wheel 10 (i.e., the left half of the chain wheel 10 as viewed in FIG. 2), square rods 12 to which the chain 11 is fixed at the end thereof by means of pins or the like, a chain (not shown) which is fixed to the square rods 12 by means of pins or the like, a chain wheel (not shown) about which the unillustrated chain is wound and a motor (not shown) which drives the unillustrated chain wheel.

In the opening 4*e* of the forward end portion 4, there are upper and lower sheave support plates 13 and 14 secured rigidly to the base portion 4*d*. A vertically extending pin 15 is secured rigidly to the sheave support plates 13 and 14 and upper and lower sheaves 18 and 19 are mounted rotatably horizontally on this pin 15 through bearings 16 and 17. The sheaves 18 and 19 constitute the first sheave in the present invention.

The sheave 18 has upper and lower wire rope engaging grooves 18*a* and 18*b* and the sheave 19 has also upper and lower wire rope engaging grooves 19*a* and 19*b*. The first sheave, therefore, has four vertically arranged wire rope engaging grooves in all. The position of mounting of the sheaves 18 and 19 is behind the position of mounting of the swivel arm 3 to the forward end portion 4 of the arm 2.

In the central portion of the swivel arm main body 6 of the swivel arm 3, there is a vertically extending pin 20 disposed in front of the center O of rotation of the swivel arm 3 and secured rigidly to upper and lower plates 6*a* and 6*b* of the swivel arm main body 6. Upper and lower sheaves 23 and 24 are mounted rotatably horizontally to this pin 20 through bearings 21 and 22. The sheaves 23 and 24 have a diameter equal to that of the first sheave 18 and 19 and constitute the second sheave of the present invention.

The sheave 29 has upper and lower wire rope engaging grooves 23*a* and 23*b* and the sheave 24 also has upper and lower wire rope engaging grooves 23*a* and 24*b*. The second sheave therefore has four vertically arranged wire rope engaging grooves in all.

In the above described construction, the swivel arm 3, the first sheave 18 and 19 and the second sheave 23 and 24 are located in such a manner that the distance between the center O of rotation of the swivel arm 3 and the center of rotation of the first sheave 18, 19 is equal to the distance between the center 0 of rotation of the swivel arm 3 and the second sheave 23, 24.

In the base portion 4*d* of the forward end portion 4 of arm 2, there are formed upper and lower passages 25 and 26 for passing wire ropes therethrough. The passages 25 and 26 communicate with upper and lower wire rope passages 27 and 28 formed in the arm main body 5.

Figure 5:
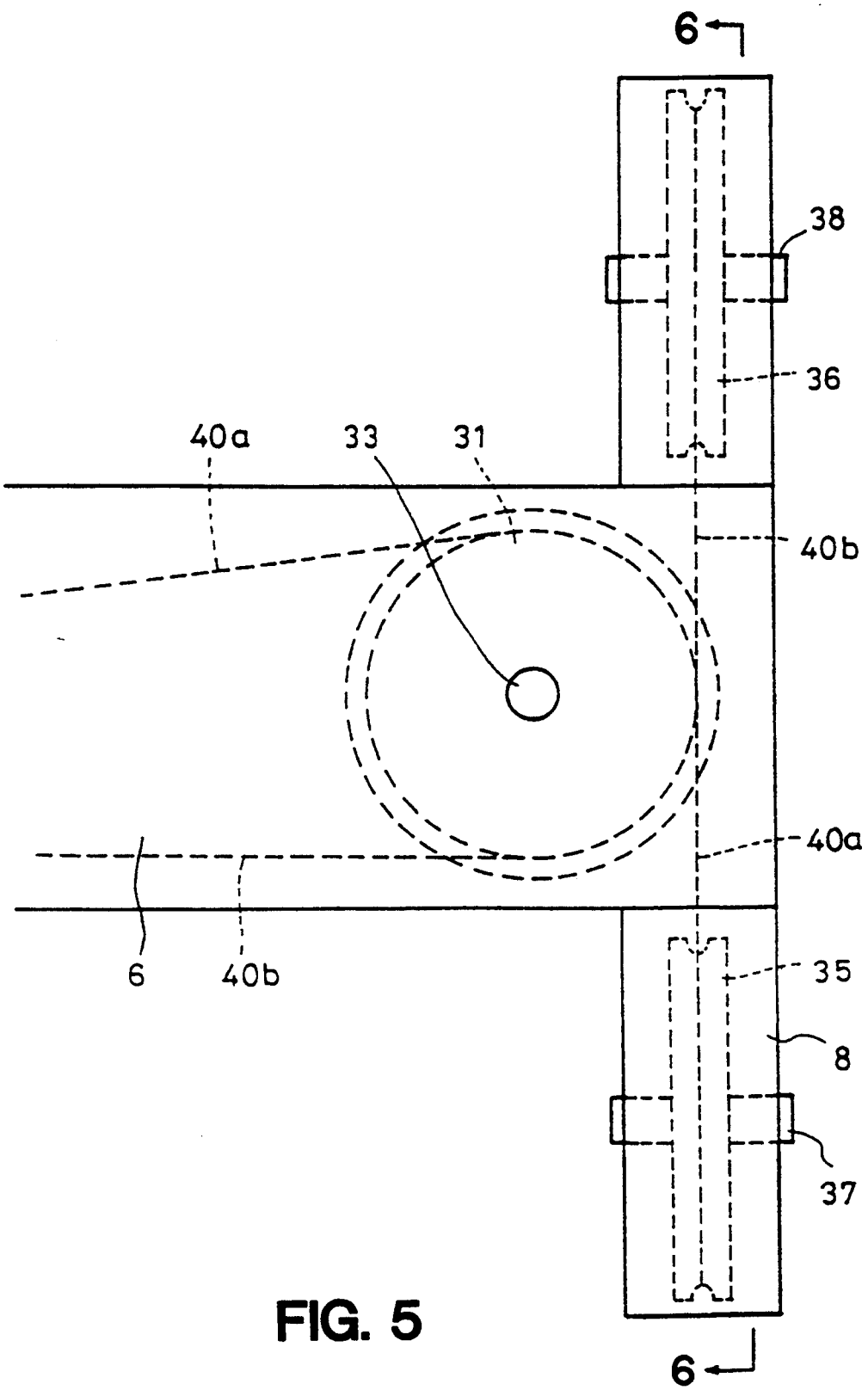
FIG. 5 is a plan view showing end portions of the swivel arm.
Figure 6:
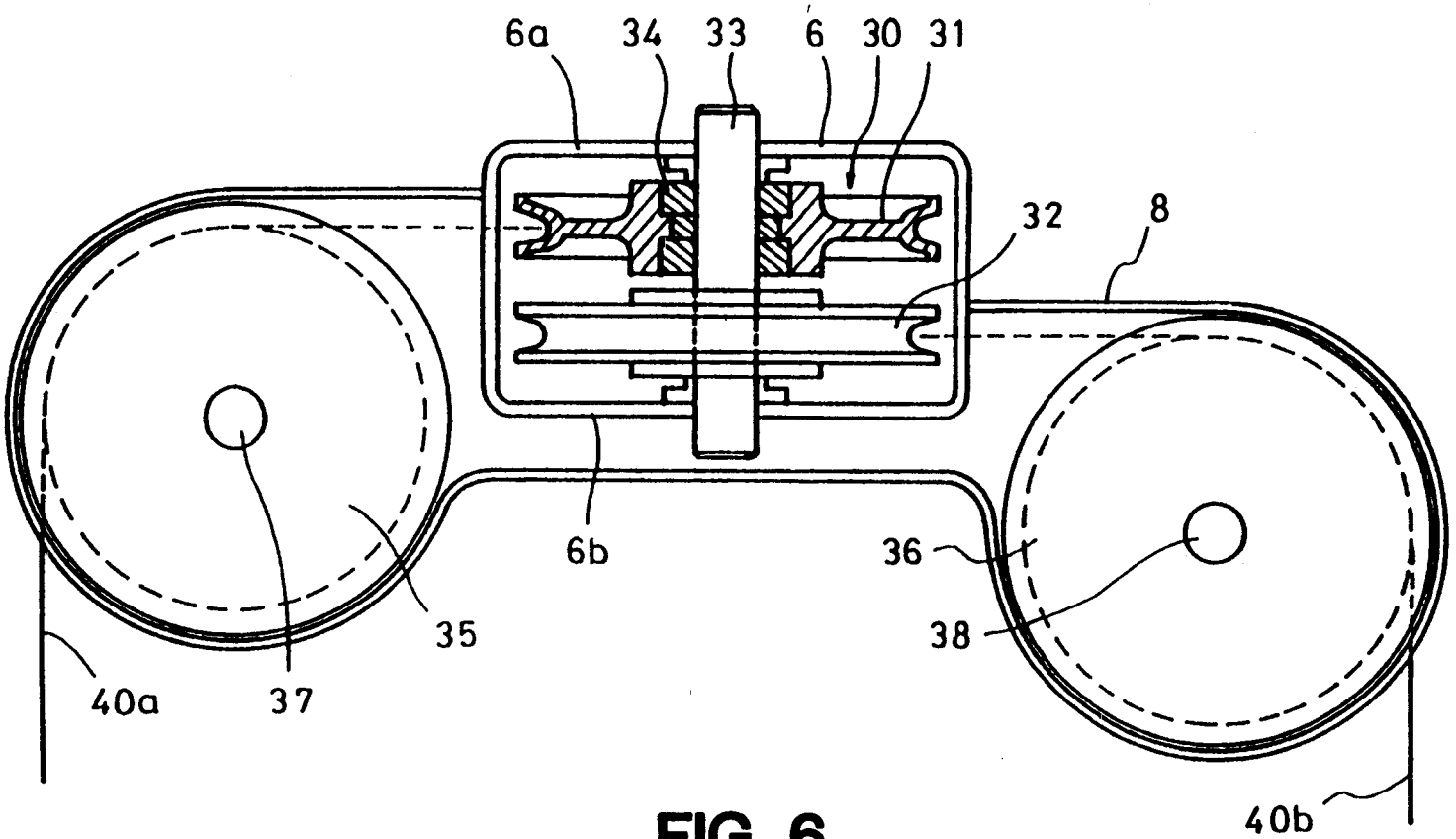
FIG. 6 a view taken along arrows B—B in FIG. 5.

In the end portions of the swivel arm main body 6, there are provided sheaves 30, 30 which are rotatable horizontally as shown in FIGS. 5 and 6. The respective sheaves 30, 30 consist of upper and lower sheaves 31 and 32. The sheaves 31 and 32 are mounted to a pin 33 secured rigidly to the upper and lower plates 6*a* and 6*b* of the swivel arm main body 6 of the swivel arm main body 6 through bearings 34. In FIG. 6, the sheave 31 only is shown in its cross section.

The working cage suspending portions 8 are provided at the end portions of the swivel arm main body 6 such that they cross the main body 6. In each of the working cage suspending portions, sheaves 35 and 36 are mounted on both sides of the swivel arm main body 6 to pins 37 and 38 secured rigidly to the side walls of the suspending portions 8 through bearings (not shown) in such a manner that the sheaves 35 and 36 are rotatable in a vertical plane and the axes of rotation thereof are parallel to the longitudinal direction of the swivel arm main body 6.

Since the sheave 35 is provided in correspondence to the upper sheave 31 and the sheave 36 in correspondence to the lower sheave 32, the sheave 35 is disposed at a higher level than the sheave 36 as will be apparent from FIG. 6.

In the present embodiment, four wire ropes 40*a*, 40*b*, 42*a* and 42*b* are used for suspending the working cage. One end of each of these wire ropes 40*a*, 40*b*, 42*a* and 42*b* is fixed to the winding device and the other end thereof is fixed to the working cage. Among these wire ropes, the wire ropes 40*a* and 40*b* are supplied to the sheaves 31 and 32 of the right side as viewed in FIG. 1 through the upper sheaves 18 and 23 and connected to the working cage through the right side sheaves 35 and 36 The wire ropes 42*a* and 42*b* are supplied to the sheaves 31 and 32 of the left side as viewed in FIG. 1 through the lower sheaves 19 and 24 and connected to the working cage through the left side sheaves 35 and 36.

Figure 3:
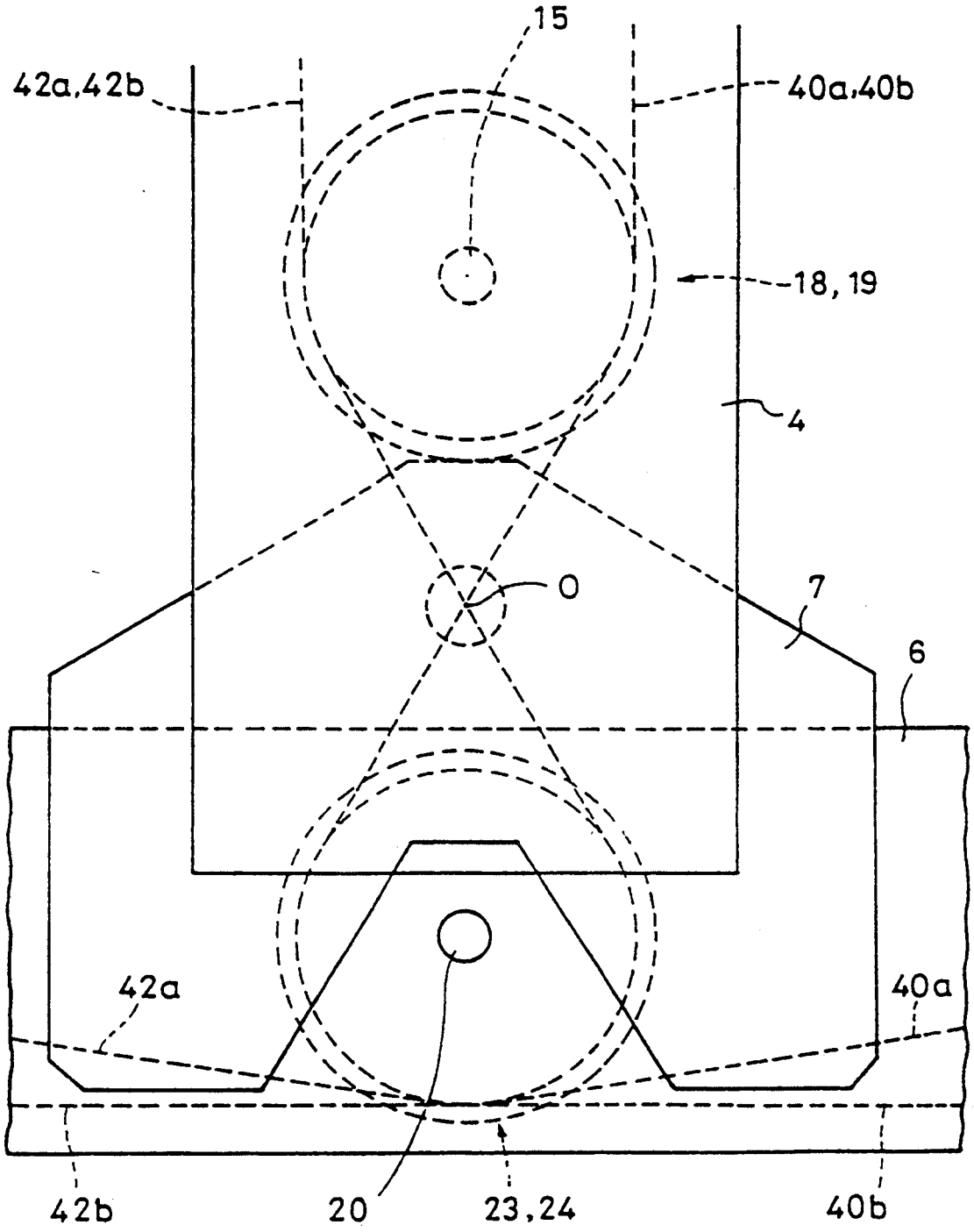
FIG. 3 is a plan view showing a state of winding of wire ropes when the swivel arm is in a neutral position.

More specifically, as shown in FIGS. 1 and 3, the wire ropes 40*a* and 40*b* fed from the winding device and supplied from the arm main body 15 engage in the grooves 18*a* and 18*b* of the upper sheave 18 of the first sheave provided in the forward end portion 4 of the arm 2 such that these wire ropes 40*a* and 40*b* are wound along the right side of the grooves 18*a* and 18*b* as viewed in FIG. 3 and, thereafter, engage the grooves 23*a* and 23*b* of the upper sheave 23 of the second sheave such that these wire ropes 40*a* and 40*b* are wound along the left side of the grooves 23*a* and 23*b* as viewed in FIG. 3. Then, the wire rope 40*a* is led from the groove 23*a* of the sheave 23 to the upper sheave 31 of the right side sheave 30 as viewed in FIG. 1 in the swivel arm main body 6 and, after engaging the upper sheave 31 shown in FIG. 5, is led to the sheave 35 and connected to the working cage disposed below through the sheave 35 as shown in FIG. 6.

The wire rope 40*b* is led from the groove 23*b* of the sheave 23 to the lower sheave 32 of the right side sheave 30 as viewed in FIG. 1 in the swivel arm main body 6 and, after engaging the sheave 32, is led to the sheave 36 and connected to the working cage through the sheave 36 as shown in FIG. 6.

The wire ropes 42*a* and 42*b* fed from the winding device and supplied from the arm main body 5 engage the grooves 19*a* and 19*b* of the lower sheave 19 of the first sheave provided in the forward end portion 4 such that these wire ropes 42*a* and 42*b* are wound along the left side of the grooves 19*a* and 19*b* as viewed in FIG. 2. Accordingly, in the neutral position of the swivel arm 3 shown in FIG. 3, the set of the upper wire ropes 40*a* and 40*b* and the set of the lower wire ropes 42*a* and 42*b* cross each other at the center O of rotation of the swivel arm 3 shown in FIG. 3. Thereafter, the wire rope 42*a* is led from the groove 24*a* of the sheave 24 to the upper sheave 31 of the left side sheave 30 as viewed in FIG. 1 of the swivel arm main body 6 and, after engaging the upper sheave 31, is led to the sheave 35 and connected to the working cage through the sheave 35.

The wire rope 42*b* is led from the groove 24*b* of the sheave 24 to the lower sheave 32 of the left side sheave 30 as viewed in FIG. 1 of the swivel arm main body 6 and, after engaging the sheave 32, is led to the sheave 36 and connected to the working cage through the sheave 36.

The operation of the above described device will now be described.

When the swivel arm 3 is in a neutral position, i.e., a position in which the swivel arm 3 is not rotated in either direction, the wire ropes 40*a* and 40*b* cross the wire ropes 42*a* and 42*b* at the center O of rotation of the swivel arm 3. The states of the wire ropes 40*a*, 40*b*, 42*a* and 42*b* in the respective parts of the device are as described above.

Figure 4:
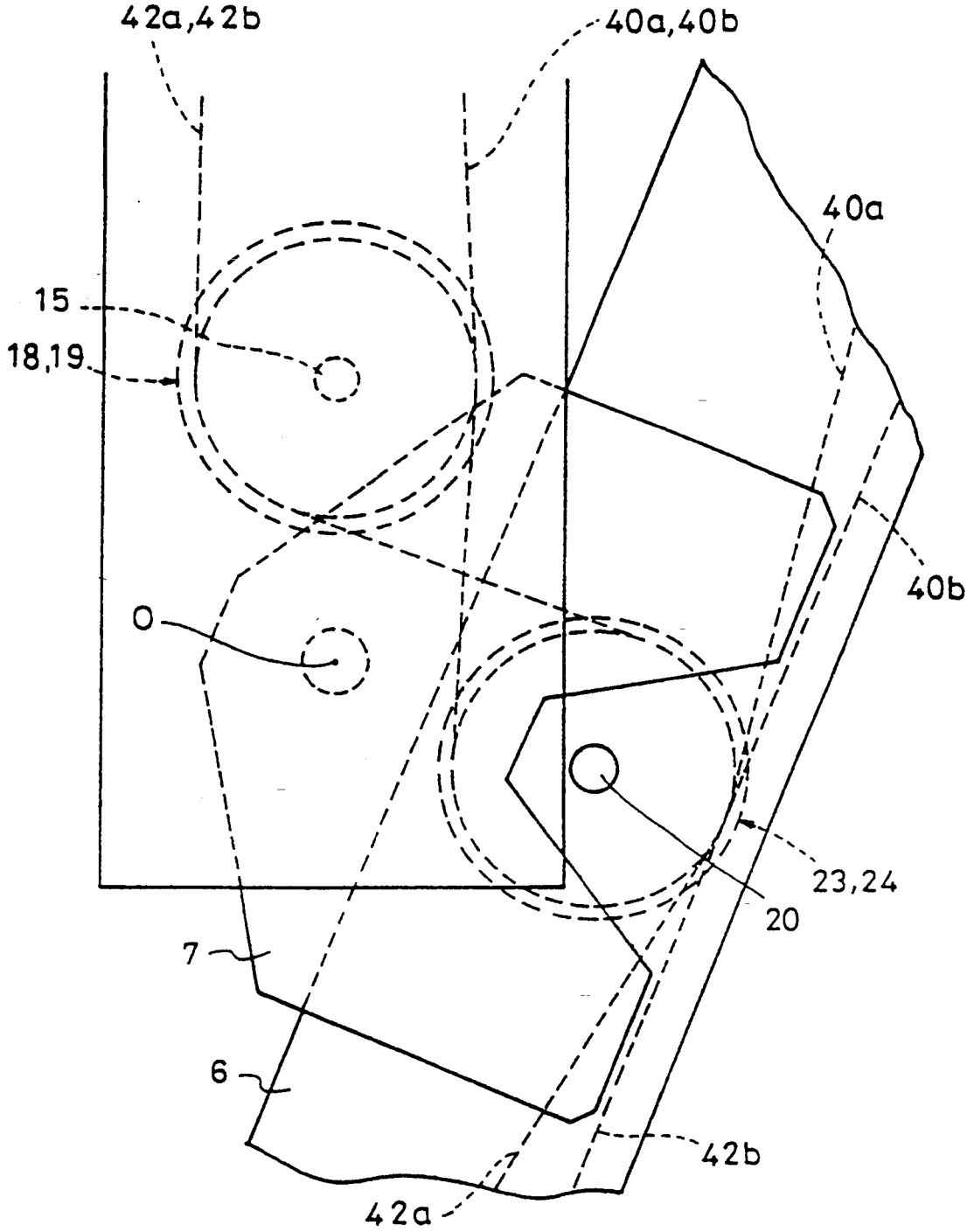
FIG. 4 is a plan view showing a state of winding of wire ropes when the swivel arm is in a rotated position.

As the swivel arm 3 is rotated counterclockwise from the neutral position shown in FIG. 3 to a position shown in FIG. 4, the crossing point between the wire ropes 40*a* and 40*b* and the wire ropes 42*a* and 42*b* is offset from the center O of rotation of the swivel arm 3. Since the first sheave 18 and 19 and the second sheave 23 and 24 are of the equal diameter and the swivel arm 3 and the respective sheaves 18, 19, 23 and 24 are disposed so that the distance between the center O of rotation of the swivel arm 3 and the center of rotation of the sheaves 18 and 19 is equal to the distance between the center O of rotation of the swivel arm 3 and the center of rotation of the sheaves 23 and 24, the sum of angle of winding of each rope about the first sheave and angle of winding thereof about the second sheave always becomes substantially constant and this relation is maintained unchanged regardless of the rotated angle of the swivel arm 3. Accordingly, the length of a fed out or withdrawn portion of each wire rope becomes the same as the length of a fed out or withdrawn portion of other wire rope. Taking, for example, the wire ropes 40*a* and 40*b*, the angle of winding of these wire ropes about the sheave 18 which constitute the first sheave in the state of FIG. 4 decreases as compared to the neutral state shown in FIG. 3 but the angle of winding of these ropes about the sheave 23 which constitutes the second sheave increases by the amount which is equal to the amount of decrease in the winding angle at the shears 18, so that the sum of the angle of winding of the wire ropes 40*a* and 40*b* about the sheaves 18 and 23 is constant. Likewise, as to the wire ropes 42*a* and 42*b*, the angle of winding of these wire ropes about the sheave 19 which constitutes the first sheave increases in the state shown in FIG. 4 as compared to the neutral state but the angle of winding of these wire ropes about the sheave 24 which constitutes the second sheave decreases by the amount which is equal to the amount of increase in the winding angle at the sheave 19, so that the sum of angle of winding of the wire ropes 42*a* and 42*b* about the sheaves 19 and 24 is constant. Accordingly, by feeding out or withdrawing the wire ropes under this condition, the length of a fed out or withdrawn portion of the wire ropes 40*a* and 40*b* becomes equal to the length of a fed out or withdrawn portion of the wire ropes 42*a* and 42*b*.

In the above described embodiment, description has been made about a case where the invention has been applied to a working cage suspending device using four wire ropes. The invention is not limited to this but it is applicable to a working cage suspending device using two wire ropes or more than four wire ropes.

In the above described embodiment, the chain driven device is used as the mechanism for rotating the swivel arm. The swivel rotating mechanism however is not limited to this but other drive mechanisms such as driving by a geared motor and driving by a wire rope may be employed.

In the above described embodiment, the first sheave is constructed of the separate sheaves 18 and 19 and the second sheave is constructed of the separate sheaves 23 and 24. Alternatively, each of the first and second sheaves may be constructed integrally.

What is claimed is:

1. A device for suspending a working cage comprising:

an arm;

a swivel arm mounted rotatably horizontally to the end portion of the arm;

a first sheave mounted rotatably horizontally to said arm at a location behind the end portion to which said swivel arm is mounted, said first sheave being formed with at least two vertically arranged grooves in which wire ropes engage;

a second sheave having a diameter equal to that of said first sheave and being mounted rotatably horizontally to said swivel arm at a location in front of the center of rotation of said swivel arm, said second sheave being formed with at least two vertically arranged grooves in which wire ropes engage;

a wire rope winding device provided on the base side of said arm for winding and unwinding wire ropes; and at least two wire ropes for suspending the working cage, one end of the respective wire ropes being attached to said wire rope winding device and the other end of the respective wire ropes being attached to said working cage, and the respective wire ropes being wound and unwound through said first sheave and said second sheave, said wire ropes crossing each other in a space between said first sheave and said second sheave, and said swivel arm, said first sheave and said second sheave being positioned in such a manner that distance between the center of rotation of said swivel arm and the center of rotation of said first sheave becomes substantially equal to distance between the center of rotation of said swivel arm and the center of rotation of said second sheave.

2. A device for suspending a working cage as defined in claim 1 wherein said arm is mounted on the upper portion of a roof car and said winding device is disposed in said roof car.

3. A device for suspending a working cage as defined in claim 1 wherein said first sheave and said second sheave respectively have four grooves in which wire ropes engage and said device has only one of said arm.

* * * * *